US009186714B1

(12) United States Patent
Middleton, Jr.

(10) Patent No.: US 9,186,714 B1
(45) Date of Patent: Nov. 17, 2015

(54) PROCESS FOR MAKING A STAMPED TUBULAR FORM WITH INTEGRAL BRACKET AND PRODUCTS MADE BY THE PROCESS

(75) Inventor: Robert L. Middleton, Jr., Middleville, MI (US)

(73) Assignee: Middleville Tool and Die Company, Middleville, MI (US)

( * ) Notice: Subject to any disclaimer, the term of this patent is extended or adjusted under 35 U.S.C. 154(b) by 1015 days.

(21) Appl. No.: 13/311,707

(22) Filed: Dec. 6, 2011

Related U.S. Application Data

(63) Continuation-in-part of application No. 11/427,512, filed on Jun. 29, 2006, now Pat. No. 8,091,201, and a continuation-in-part of application No. 13/286,611, filed on Nov. 1, 2011, now abandoned.

(51) Int. Cl.

| | |
|---|---|
| ***B21D 39/03*** | (2006.01) |
| ***B23P 11/00*** | (2006.01) |
| ***B21D 5/01*** | (2006.01) |

(52) U.S. Cl.
CPC ..... *B21D 5/015* (2013.01); *Y10T 29/49334* (2015.01); *Y10T 29/49622* (2015.01); *Y10T 29/49826* (2015.01); *Y10T 29/5124* (2015.01)

(58) Field of Classification Search
CPC ..... B21D 5/015; Y10T 29/49826; Y10T 29/49622; Y10T 29/49334; Y10T 29/5124
See application file for complete search history.

(56) References Cited

U.S. PATENT DOCUMENTS

| | | | | |
|---|---|---|---|---|
| 1,770,284 | A * | 7/1930 | Bassett | 294/57 |
| 1,970,137 | A * | 8/1934 | Harte | 76/113 |
| 4,148,426 | A | 4/1979 | Midzutani et al. | |
| 4,860,570 | A | 8/1989 | Perrault et al. | |
| 4,991,419 | A | 2/1991 | Kuroda et al. | |
| 5,756,167 | A * | 5/1998 | Tamura et al. | 428/31 |
| 6,408,670 | B1 | 6/2002 | Trapp | |
| 6,418,611 | B1 | 7/2002 | Weber et al. | |
| 6,591,648 | B1 | 7/2003 | Ash et al. | |
| 6,892,559 | B2 | 5/2005 | Lieponen | |
| 6,904,677 | B2 | 6/2005 | Yamauchi | |
| 6,920,773 | B2 | 7/2005 | Lieponen | |
| 7,055,353 | B2 | 6/2006 | Cowie | |

* cited by examiner

*Primary Examiner* — Peter DungBa Vo
*Assistant Examiner* — Jeffrey T Carley
(74) *Attorney, Agent, or Firm* — Kane & Co., PLC

(57) ABSTRACT

The provided process creates a stamped tubular form with integral bracket by feeding a metal strip with a first thickness into a stamping tool containing a plurality of stations. Material is removed from the metal strip, leaving behind a tubular blank with an integral bracket. The tubular blank is formed by a forming station into a U-shaped form containing walls. The walls are closed in a closure station into a tubular shape wherein the edges of the walls are abutted and compressed, forming a tubular form which increases the metal thickness. This invention includes products formed by this process.

9 Claims, 8 Drawing Sheets

Section A-A

Detail B

Detail C

Detail D

Detail E

Detail F

Detail G

Section H-H

Section J-J

Section K-K

Section L-L

PROCESS FOR MAKING A STAMPED TUBULAR FORM WITH INTEGRAL BRACKET AND PRODUCTS MADE BY THE PROCESS

CROSS REFERENCE TO RELATED APPLICATIONS

This application is a continuation-in-part from the earlier filed and still pending U.S. non-provisional patent application entitled, "PROCESS FOR MAKING ARCUATE STAMPED TUBULAR MEMBERS AND PRODUCTS MADE BY THE PROCESS," assigned Ser. No. 13/286,611, and filed on Nov. 1, 2011, the contents of which are incorporated herein by reference; which is a continuation-in-part from the earlier filed and still pending U.S. non-provisional patent application entitled, "STAMPED TUBULAR MEMBER AND METHOD AND APPARATUS FOR MAKING SAME," assigned Ser. No. 11/427,512, and filed Jun. 29, 2006, the contents of which are incorporated herein by reference.

BACKGROUND OF THE INVENTION

1. Field of the Invention

This invention relates to tubular formed products, more particularly, the process of shaping or forming tubular shapes, and specifically to the process of forming a tubular member including an integral bracket.

2. Description of the Related Art

The history and background of making tubes and pipes will not be addressed in any significant detail herein; however common methods for forming tubular products include roll forming, extrusion, hydroforming, casting, and machining. Each method has its own individual drawbacks discussed below.

Roll forming is a process which imparts a tubular shape to flat stock by imparting a radius to the sheet stock as it is passed linearly, through a plurality of rollers. The rollers, referred to as roller dies, are precision made for each job. As the sheet metal passes through each set of rollers, the rollers change the profile of the metal. Through successive rolling operations the roller stations may create profiles which are substantially closed, but none which are tightly controlled. These rolled profiles have varied applications in manufacturing, commercial building, aerospace and other sectors however are inapplicable to forming tightly sealed tubing since rolling can not fully and tightly close a tubular seam with an attached bracket.

Another method for creating tubular structures is by a process called extrusion. Extruded tubular articles are formed by forcing material through a die containing the material's desired final cross section. The material being extruded is typically forced through the die by a large hydraulic press, causing the material to locally 'flow' through the die resulting in the final shape. Product formed by this method may contain well formed seams; however this process is only suited to products containing a uniform cross section, such as rails or pipe, as extrusion machines are unable to produce tubular members which have attached non-uniform sections such as brackets or flanges.

Hydro-forming is process which uses a pressurized fluid to shape and form a part. Hydro-forming is principally described as either sheet hydro-forming, or tube hydro-forming, depending on the form of the blank inserted into the machine.

In sheet based hydro-forming, a blank is placed against a male portion of the die, and a high pressure fluid is applied to the opposite side of the sheet forcing the material to conform to the male half of the die. Localized thinning and wrinkling of the sheet are common occurrences, and closed tubular forms can not be formed by this method alone.

Tube based hydro-forming places a tubular shaped blank into a hydroforming tool and then applies pressurized fluid to the interior walls of the tube causing the tube to expand to the limits of the die chamber. The process is commenced by sealing the tubular blank, and injecting hydraulic fluid into the sealed tube through one of two axial end punches. These axial end punches are movable and are also used to apply an axial load upon the blank to feed material towards the center of the expanding tube. The tubular blank must contain a wall thickness which is far thicker than required of the final form in order to accommodate the localized thinning that occurs when the tube expands toward the limits of the die chamber. Further, the blank form itself must be substantially fluid-tight in order to contain the hydroforming fluid. This fluid-tight requirement precludes the use of open form brackets attached to tubular members.

Another method of making complex tubular products is by casting. In casting, molten metal is supplied into a mold form where it then cools, solidifying into its final product shape. This method often traps air and other impurities in the casting substantially weakening the part. Further, the properties of the material made by casting are not metallurgically nor structurally similar, and are often not as strong as a cold worked stamped products of the same shape. Castings often requiring a separate annealing and heat treatment process to approach similar product strength. Further still, casting requires specialized alterations to the final part such as parting lines, and ejector pins, each of which affects the geometry of the part.

Yet another method for making tubular work pieces is via machining. The advent of computer aided machining now allows for complex shapes to be milled from solid billet material. However, when it comes to machining tubular products, the results are limited to those shapes which may be plunge cut, broached, or turned on a lathe. Similar to castings, the properties of the billet material differ metallurgically and structurally from stamped material due to the lack of cold working of the material.

Tubular products with attached brackets may be achieved using welding. A tubular form may be manufactured separately from the bracket. The parts are then brought into contact, and a welding tool locally heats the parts causing localized sections of the parts to melt and flow together. When the parts cool, they will become conjoined. This localized melting and reforming alters the properties of the base metals, creating stress risers and other aberrancies which affect the structural integrity of the components due to their altered crystalline form.

U.S. Pat. Nos. 6,920,772; 6,904,677; 6,892,559; 6,591,648; and 4,991,419 further describe the formation of tubular products by roll forming, hydro-forming, and other techniques, and are incorporated herein by reference.

As noted above, roll formed products are unable to produce tightly formed seams. Extruded tubes are inherently linear, and are unable to process brackets integral to the tubing. Sheet hydro-forming, similar to roll form materials, is unable to form tightly closed forms. Tube hydro-forming is not an available option, as brackets attached to the tubular form interfere with the sealed surfaces necessary to form the tube. Casting, machining, and welding all result in a non-identical metallurgical structure and strength. Consequently, none of the methods described above are appropriate for manufacturing of a tubular work pieces with a precision seam attached to an integral bracket.

The invention described herein solves the disadvantages noted in the prior art above by providing a method for forming flat metal stock into a tubular form with a tightly formed precision seam attached to integral flange or bracket. Further, the inventive process described forms flat metal stock into a tubular form with a tightly formed precision seam attached to integral flange or bracket further containing one or more notches coined into the tube.

SUMMARY OF THE INVENTION

One form of the invention includes a process for making a tubular form with integral bracket through the use of a stamping operation by providing a sheet of metal stock having a first wall thickness. The sheet of metal is blanked in a blanking station, removing material from the metal strip, leaving behind a blank form containing an integral bracket portion and tubular blank portion. The tubular blank portion is formed by a forming station in the stamping tool into a partially closed form containing two wall members, each having a longitudinal edge. A portion of the two wall members are bent toward one another in a closure station until said longitudinal edges are proximate one another substantially forming a tubular shape. The longitudinal edges are then abutted in a compression station forming a tubular shape.

Another form of the invention includes a process for making a tubular form with integral bracket by stamping which results in a sheet of metal stock having a first wall thickness. This sheet of metal is fed into a blanking station which removes material from the strip and forms a blank containing an integral bracket and a flat tubular blank form with at least two opposing sides. The flat tubular blank is then formed into a U-shape in a drawing station. The U-shape is closed into a tubular form in a closure station by bringing the two opposing sides together to form a tubular blank having a seam. This tubular form is compressed into its final shape in a compression station, wherein the seam between the two opposing sides is forced into intimate contact and the first wall thickness is increased.

In another form of the invention, the provided process creates a tubular form with integral bracket by feeding a strip of metal into a stamping assembly containing a plurality of tool stations. A blanking station removes material from the metal strip forming a blank shape containing an integral bracket portion connected to a flat tubular blank. The tubular blank portion itself contains at least two opposing sides, further containing a flared portion, and a reduced portion. The stamping assembly forms the flat tubular blank in a forming station by placing an offset and a dart into the bracket portion as well as placing a curvature into the peripheral edges of the tubular blank section forming curved walls thereupon. The blank form is then formed in a drawing station creating a U-shaped form, wherein the workpiece's curved walls are straightened by the tool. The U-Shaped form is closed in another station by bending the walls toward each other until they form a tubular shape with a seam between the opposing edges of the walls. These opposing edges abut one another and the tubular shape compressed to a finished size. This compression reduces the diameter of the tubular section while simultaneously increasing wall thickness creating a tubular member with an integral bracket. The bracket portion of the part may be trimmed creating a completed workpiece which is then removed from the stamping assembly.

The process described herein may also include one or more re-striking steps wherein the tubular work piece is further compacted, forcing the edges of the work piece together to form a substantially tight seam. Additionally, the process may also include steps to impart one or more holes into the bracket or tubular portions of the workpiece. These optional holes may be placed into the part at any time during the process; however they are preferably placed into the part during the blanking operation while the part is still flat, or after the tubular form has been fully formed in the compression station.

Another form of the invention may also include one or more coining to create a depression in the part. This depression may be of any shape, and includes both circular and slot like forms. The coining operation may be performed at any time during the process, but is preferred to be placed in the open U-shaped form of the work piece, while its supported from the opposite side of the punch via the die. Alternately, it may be placed into the workpiece during the compacting operation while the tooling which performs the compressive step still surrounds the part and provides a compressive load.

The invention covers and includes the products created by the processes described above. These and other advantages will become readily apparent to the reader from the detailed description of the different forms of the process, particularly when considered in combination with the drawing figures accompanying the application.

BRIEF DESCRIPTION OF THE DRAWING FIGURES

DETAILED DESCRIPTION OF THE INVENTION

Figure 5:
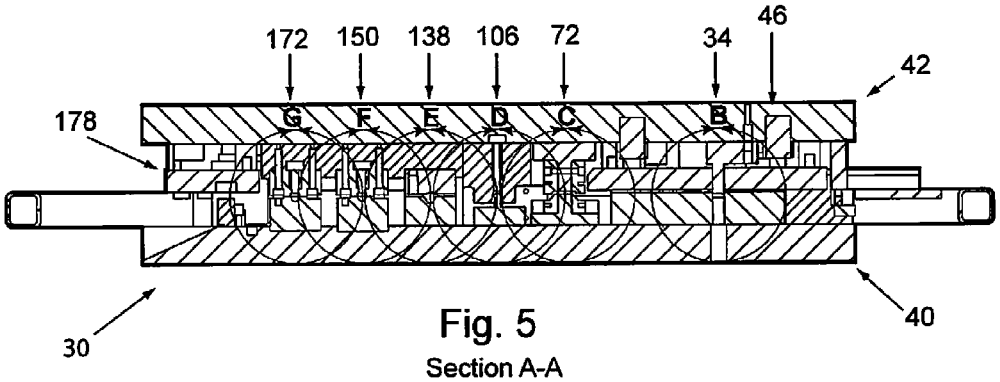
FIG. 5 is a cross section view of the upper and lower portions of the dies shown in FIGS. 3 and 4 taken along line A-A.
Figure 6:
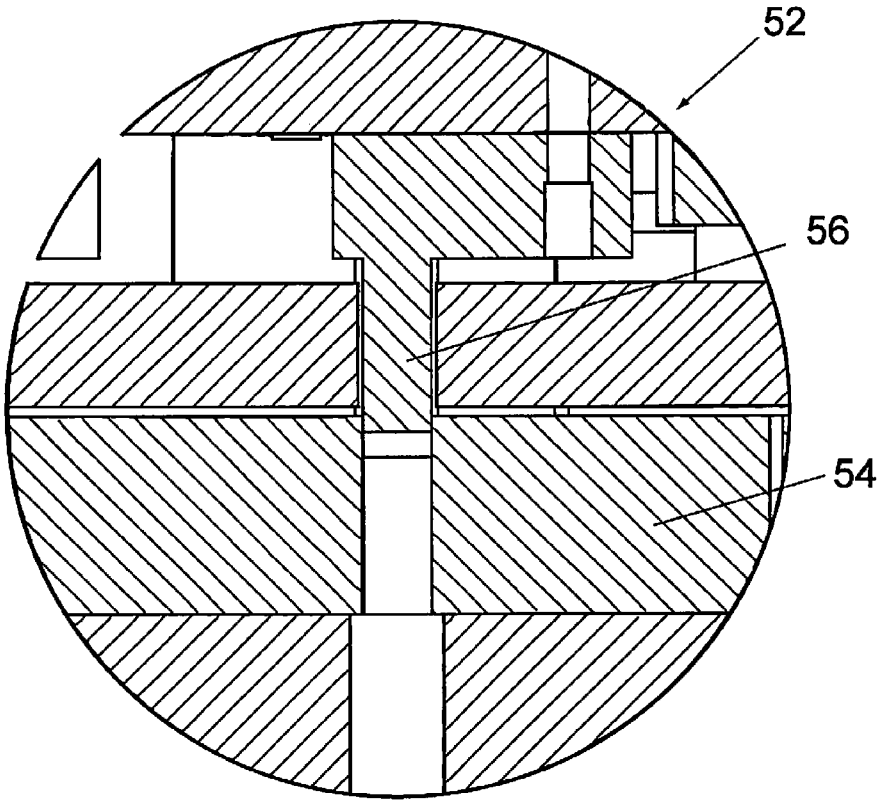
FIG. 6 is a detail view of area B as shown in FIG. 5.

For the express purpose of the following description, the terms "upper," "lower," "right," "left," "rear," "front," "vertical," "horizontal," and derivatives thereof shall relate to the inventive tool as oriented in FIG. 5. It should be understood the invention may assume different orientations and/or alternative steps or sequences unless it is expressly specified to the contrary. It should also be understood that the specific structures, devices, and processes illustrated in the accompanying drawing figures and described in the following specification are simply exemplary embodiments of the concepts and which are limited or restricted as defined in the appended claims. For instance, one skilled in the art would understand and appreciate that the process described could be performed in either a progressive or a transfer die system; with or without a carrier web. Hence, specific dimensions and other physical characteristics relating to the embodiments or tooling described shall not be considered limiting, unless expressly stated otherwise in the specification or the claims.

Reference is made to the term dart, which is defined to mean a reinforcement structure placed into a stamped part. One form of a dart used with this invention includes a ridge of material placed between two adjacent faces of a bracket to stiffen the surfaces relative to one another. Other forms of darts may include structures such as ribs or beads which are used to stiffen or reinforce a stamped component.

Reference is also made to the term coining, which is defined to encompass the various levels of deformation which may be placed into a part's surface. The term coining includes but is not limited to deformations which: locally thin or displace material; deformations which deform the shape of the part without localized thinning; and deformations which partially or wholly perforate the structure, creating a projection of material on the opposing side of the tool.

Reference is further made to the term integral, which is defined to mean an object that is part of, pertaining to, or belonging to a part of the whole; constituent or component. As used herein an integral bracket attached to a tubular member, refers to a bracket which is formed from, pertains to, or is part of the whole of the sheet of metal from which it is formed.

Figure 2:
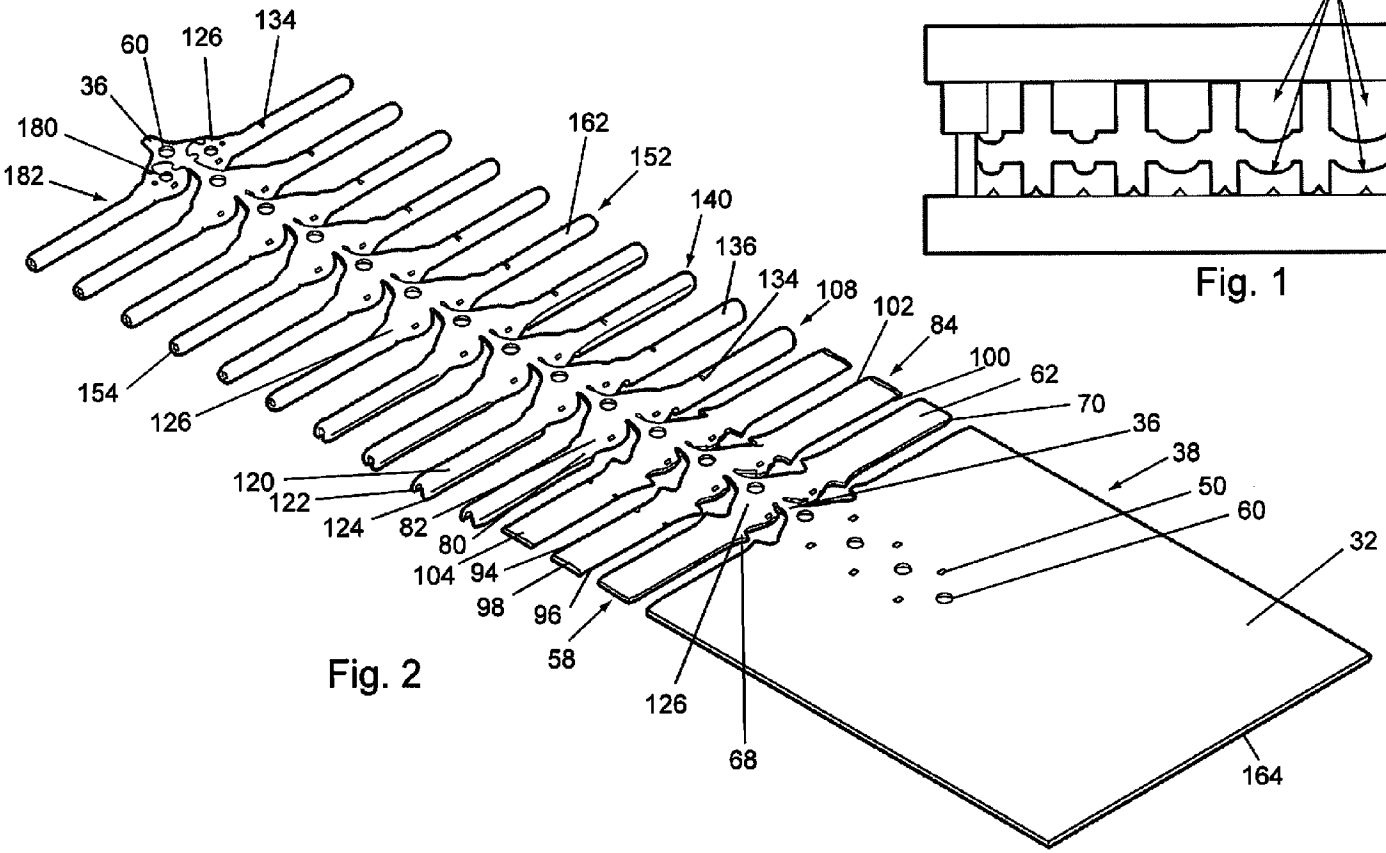
FIG. 2 is an isometric view of a work piece showing the progression of the steps according to one form of the invention.

In the following description, references are made to a sheet of metal which is worked on in combination with the invention. The sheet of metal is not shown in combination with the tooling in order to simplify the description and make identification of the tooling components easier. Exemplary forms of parts formed by this process are shown in FIGS. 12-19 to better describe the function of the tool upon the workpiece. Those skilled in the art will understand the implications of each step in the method described below, and should fully appreciate the resulting impact on any sheet of metal or work piece formed as a result of the tool interactions described herein. An example of this work piece is shown in FIG. 2.

Figure 1:
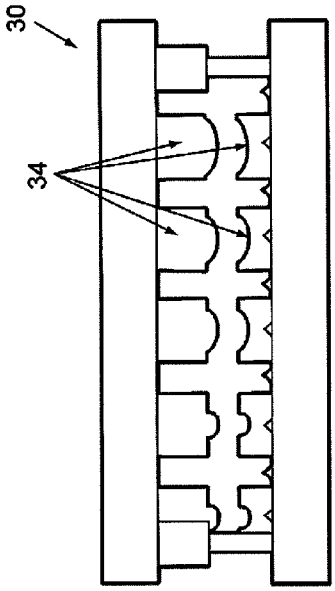
FIG. 1 is an elevation view of a simplified progressive die assembly.

Progressive dies assemblies, generally identified by numeral 30 shown in FIG. 1, are among the most common type of multiple operation tools currently used in the metal stamping industry. As the name implies, the tool progresses a part through a sequence of punching, drawing, cutting, or other operations. The part begins as a continuous sheet of metal strip 32, shown in FIG. 2, which then progresses through a sequence of tools 34, shown in FIG. 1, arranged on the progressive die 30. The various operations progressively alter the original flat sheet of material until a finished part or work piece is formed and separated from the sheet material. Current progressive die systems such as the one shown at 30 generally move the work piece from station-to-station by way of a carrier strip, carrier ribbon, or strip skeleton typically along the center or edges of the metal sheet to provide a structural bridge between the parts as the parts are progressively formed along the sequence of tools 34. The carrier strip 36 described herein is located along the middle of the metal sheet and lies outside of the finished product area. This carrier strip 36 is shown best in the exemplary progression 36 in FIG. 2. Alternatively, the carrier strip may optionally be removed from the work piece, the piece thereafter being transported through the die by a transfer process. The transfer process would then transfer the part from station to station. This transfer process is well known in the art and may be implemented by external robots for instance. For further information on progressive dies and their operation, the reader is directed to the disclosure contained within U.S. Pat. Nos. 7,055,353, 6,408,670, and 4,418,611, the content of which are incorporated herein by reference.

Figure 3:
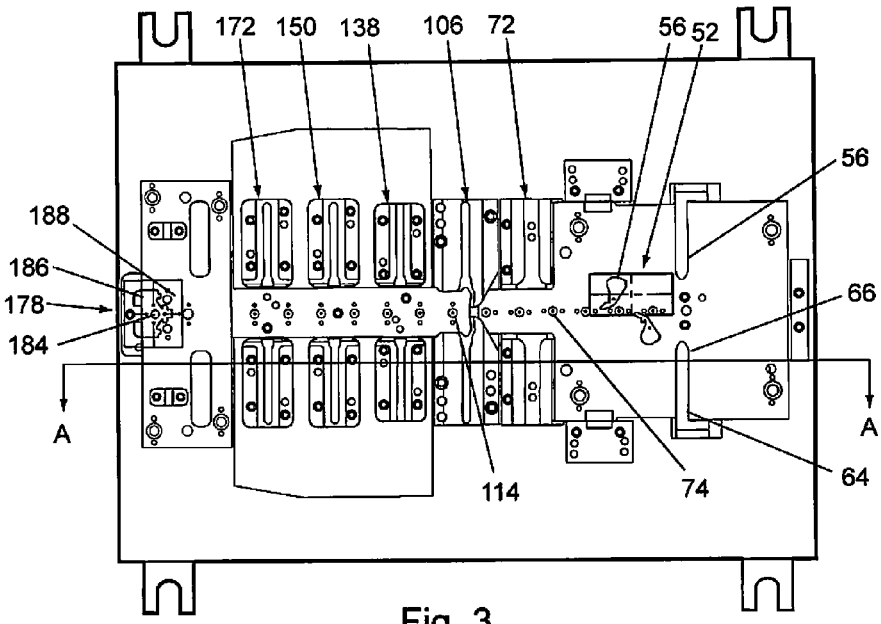
FIG. 3 is a bottom view of the upper portion of a die assembly for use with the invention.
Figure 4:
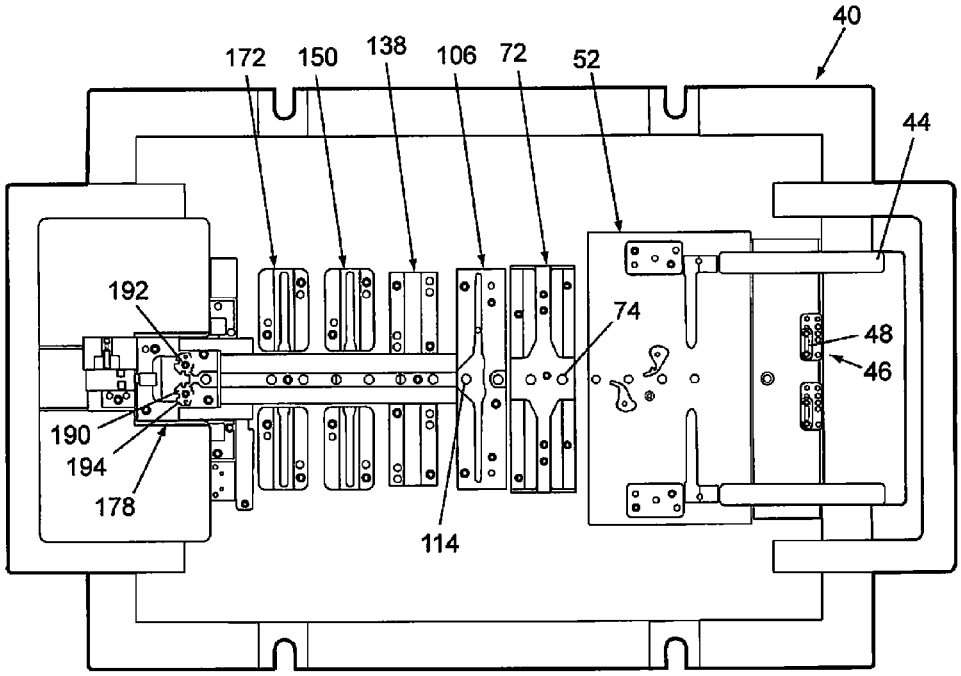
FIG. 4 is a plan view of the lower portion of a die assembly for use with the invention.

FIG. 1 generally illustrates one example of a progressive die assembly 30 that may be used to produce a form in accordance with the invention. This sequence of tools 34 disposed on the die assembly 30 is designed to form the stamped tubular form with integral bracket described below and shown in FIGS. 12-19. For the purposes of this description, in FIGS. 3 and 4, only one-half (40 lower, 42 upper) of the die tools are shown so that the reader can appreciate the tooling. A cross section of FIGS. 3 and 4 is shown in FIG. 5, detailing the interface of the tool cavity formed when the lower 40 and upper 42 halves of the die tool are brought together. Each principal operation is individually featured in FIGS. 6-11, which details the individual tooling associated with each operation performed therein.

Referring to one exemplary embodiment of the process, the tooling being shown in FIGS. 3-11, and the workpiece in FIGS. 2, and 12-19, a metal strip 32, is fed into the die assembly 30 from one end of the tool. As the strip 32 enters the tool, it is aligned with the tool through the use of alignment guides 44 shown in FIG. 3, which are positioned in the lower half 40 of the die tool 30 to guide the metal strip 32 toward the first station. As the metal strip 32 progresses further toward a blanking station, an optional marking station 46 may impress one or more alpha-numeric punches 48 into the sheet stock leaving behind an indicium 50 shown in FIG. 2, such as a part number. Next, the metal strip 32 is passed into a blanking station 52 shown in FIG. 6, which removes excess material from the metal strip 32, by supporting the metal strip against a blanking die 54, and forcing one or more punches 56 through the metal strip 32 creating the blank shown generally at 58. This blank 58 may optionally be left attached to a carrier strip 36. Blanking station 52, may optionally be used to place holes, such as pilot hole 60, into the carrier strip 36. The blanking station's punch 56, may further contained a flared portion 64, and a reduced section 66, used to form a flared portion 68 and a reduced portion 70, on a tubular blank 62 shown in FIG. 2.

Figure 7:
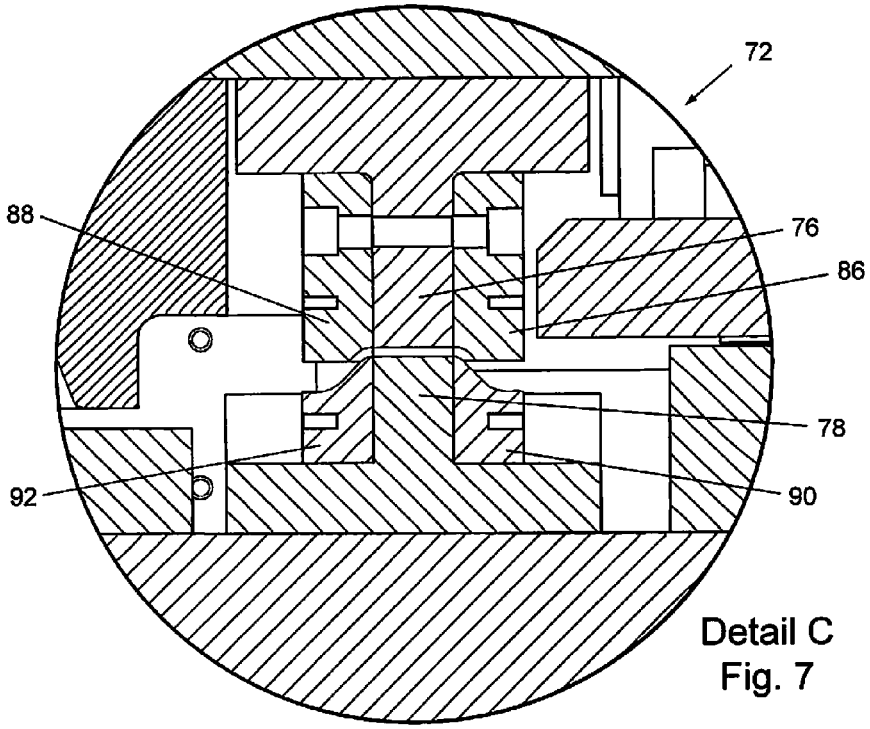
FIG. 7 is a detail view of area C as shown in FIG. 5.

In the next station of die assembly 30, the carrier strip transports the blank form 58 shown in FIG. 2, into a forming station 72 shown in FIG. 7. The blank 58 may be aligned with the forming station 72 through the use of set of piloting pins 74 which engage optional pilot holes 60 of the blank 58. If optional pilot holes 60 are not present, other exterior features will be used to positively align the blank 58 within the forming station 72.

Forming station 72, shown in detail in FIG. 7, comprises an upper forming punch 76 and a lower forming die 78 which are complimentary and when brought together impart optional offset 80 and optional dart 82 to the blank form 58 forming a first stage blank shown generally at 84 in FIG. 2. The forming station 72, shown in FIG. 7, further contains shaped surfaces 86, 88, 90, and 92 which impart a curvature to the periphery of opposing sides 94, 96 and base 98 of the first stage blank forming curved walls 100, and 102, leaving an unworked central region 104.

Figure 8:
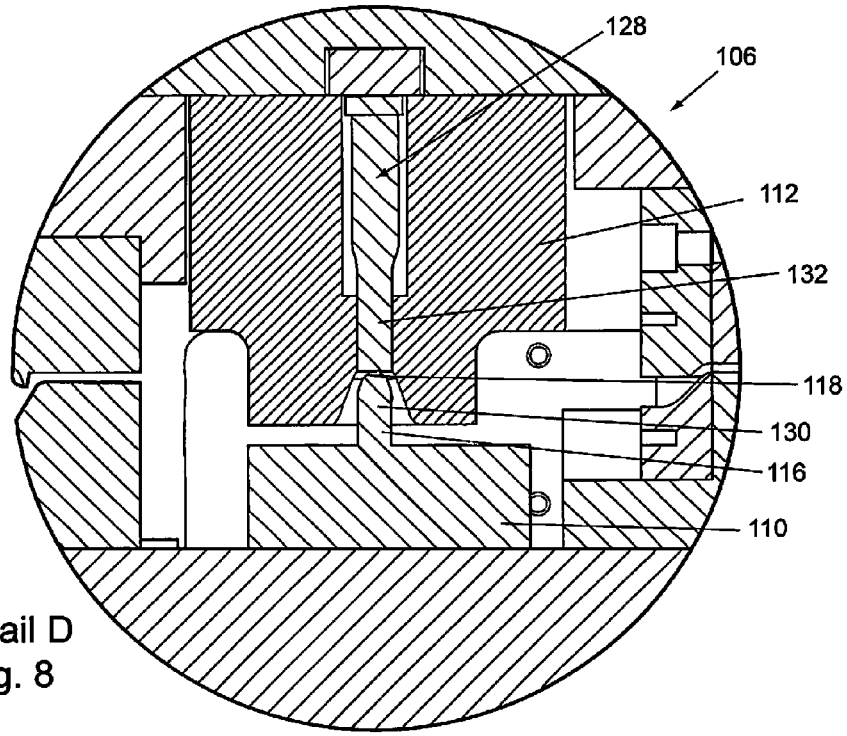
FIG. 8 is a detail view of area D as shown in FIG. 5.

In the next station of die assembly 30, a drawforming station shown generally at 106 in FIG. 5 and in detail in FIG. 8, forms the first stage blank 84 into a U-Shaped Blank shown generally at 108 in FIG. 2. The draw-forming station 106 comprises a drawing punch 110 working in conjunction with a drawing cavity 112 shown in FIG. 8. After the work piece enters the drawforming station 106, the first stage blank 108 is aligned with the station through the use of set of piloting pins 114, shown in FIG. 4, which engages optional pilot hole 60 of the first stage blank 84. If optional pilot hole 60 is not present, other exterior features will be used to positively align the first stage blank 84 within the draw forming station 106.

Once the first stage blank 84, shown in FIG. 2, is positioned into the drawforming station 106 shown in FIG. 8, the blank is drawformed by forcing a drawing punch 110 into a complimentary drawing die cavity 112. This causes the unworked central region 104 of the first stage blank 84 to be worked, bringing the curved opposing sides 94 and 96 into contact with the upper portion 116 of the drawing punch 110 as the unworked central region 104 is formed around a U-shaped form 118 at the tip of the drawing punch 110 forming a U-shaped bend 120 in the workpiece. Since the curved walls 100 and 102 were worked in an earlier station, these regions have become slightly strain hardened, rendering the unworked central region 104 of the first stage blank 84 more receptive to the U-shaped form 118 of the drawing punch 110. As the drawing punch 110 approaches the bottom of its stroke, the curved walls 100, and 102 of the work piece, come into contact with the drawing cavity 112 forcing the curved walls 100 and 102 tightly against the drawing punch 110 straightening the curved surfaces 100, and 102 into straight walls 122, and 124. This creates a U-Shaped Blank shown generally in FIG. 2 at 108, with straight wall portions 122, and 124.

In the drawform station 106, shown in FIG. 8, optional dart 82 shown in FIG. 2, helps constrain the drawforming operation to the curved opposing walls 100 and 102 and the unworked central region 104 of the first stage blank 84. Optional dart 82 accomplishes this isolation by adding a structural stiffness to a bracket portion 126 of the U-Shaped Blank 108 allowing it to remain substantially flat during the drawforming operation.

The drawforming station 106 shown in FIG. 8 may optionally include a coining tool 128, which is comprised of a support zone 130 in the drawing cavity 112, and a coining punch 132 located on the drawing punch 110. Coining tool 128 operates by placing an indentation 134 into the radius 136 of the U-shaped blank 108 shown in FIG. 2.

Figure 9:
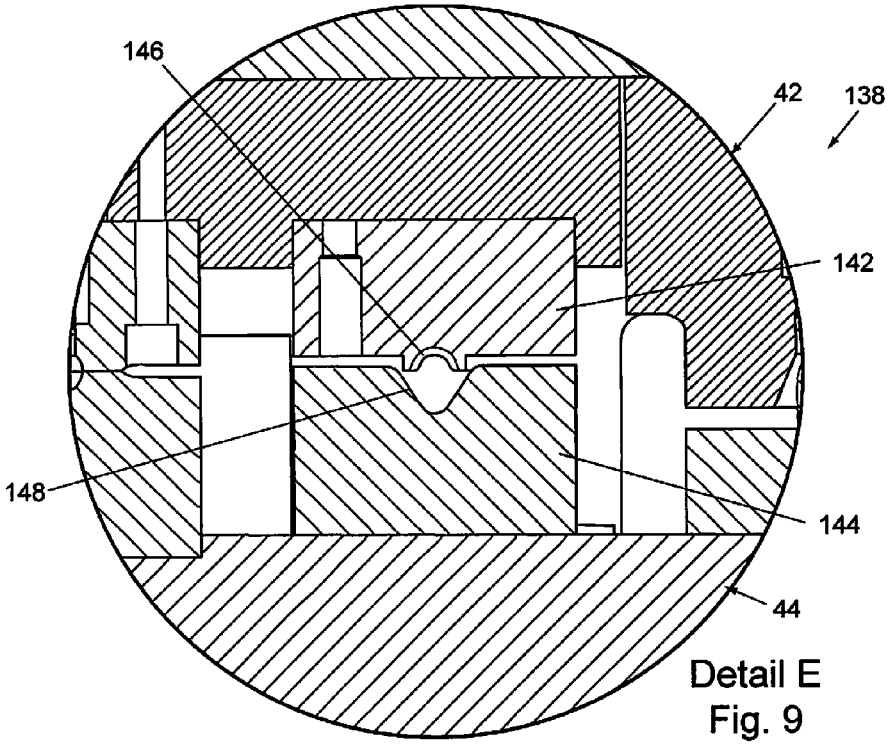
FIG. 9 is a detail view of area E as shown in FIG. 5.

A closure station shown at 138 in FIG. 5 and in detail in FIG. 9 begins the process of closing the U-shaped blank 108 by forming a substantially tubular work piece shown generally at 140 in FIG. 2. Closure station 138 includes a closure punch 142 attached to the upper half 42 of die assembly 30, and is complimentary with a closure support die 144 located on the lower half 40 of die assembly 30.

Attached to the closure punch 142 is a complimentary support form 146 which is substantially similar in shape to the U-shaped bend 120, of the U-shaped blank 108 shown in FIG. 2. This station is sized to allow the part to freely fit into the form, and engages and supports the U-shaped bend 120 of the workpiece as it is closed.

Attached to the closure support die 144, shown in FIG. 9, is a substantially "V" shaped form 148 which directs the straight wall portions 122 and 124 of the U-shaped blank 108, shown in FIG. 2, inwardly toward one another as the punch strokes downward toward the workpiece. Closure support die 144 further directs flared portions 68 of the workpiece inwardly reversing any curvature remaining in this region after the drawforming station 106 shown in FIG. 8. Alternate embodiments of a closure station may also include an upper closure punch 142 and a lower closure support die 144, which vary in height or curvature to accommodate alternative arcuate tubular shapes with attached integral brackets.

Figure 10:
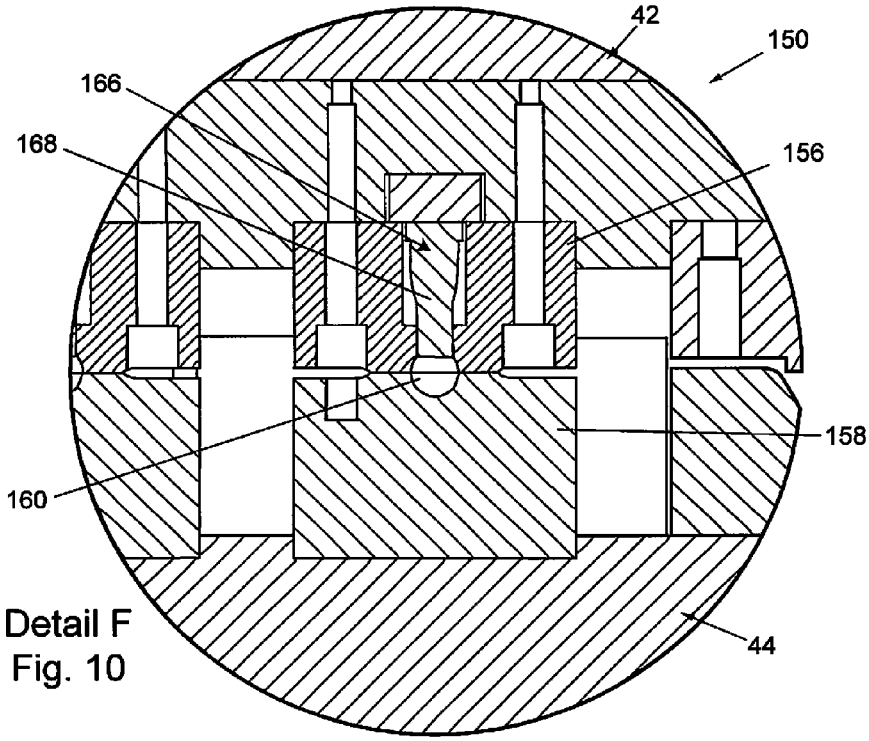
FIG. 10 is a detail view of area F as shown in FIG. 5.
Figure 11:
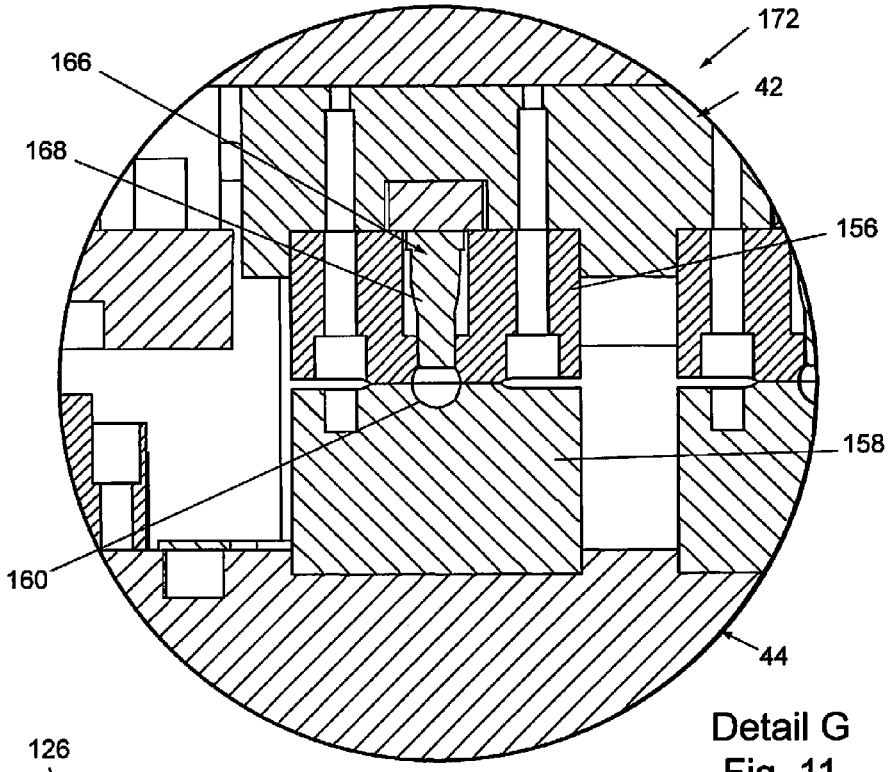
FIG. 11 is a detail view of area G as shown in FIG. 5.
Figure 12:
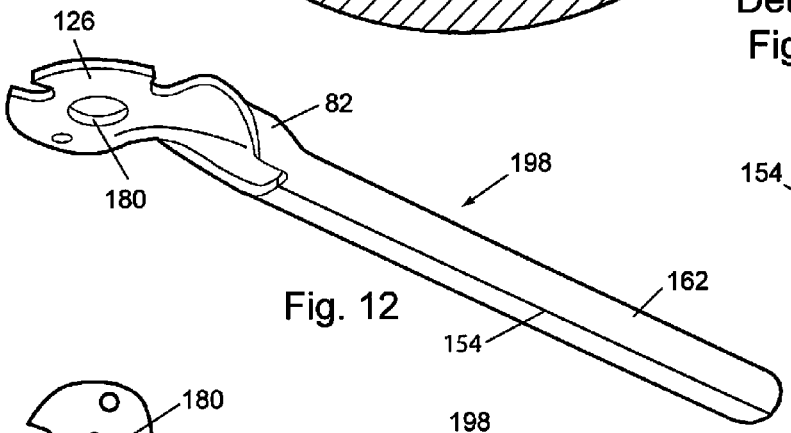
FIG. 12 is an isometric view of a tubular form with integral bracket created according to one embodiment of the invention.
Figure 15:
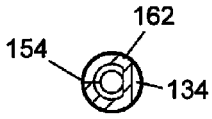
FIG. 15 is a cross section view of the tubular form with integral bracket shown in FIG. 15 taken along line H-H.
Figure 13:
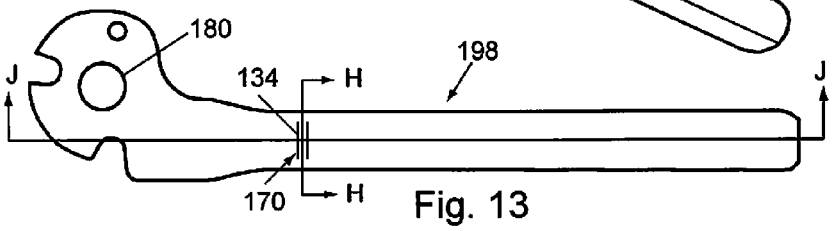
FIG. 13 is a top view of the tubular form with integral bracket shown in FIG. 12.
Figure 14:
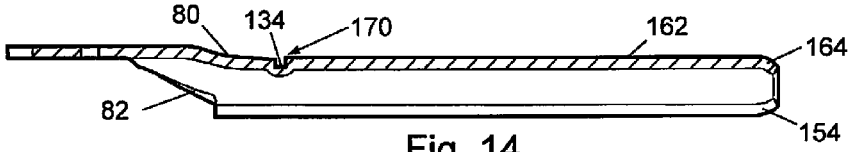
FIG. 14 is a cross section view of the tubular form with integral bracket shown in FIG. 13 taken along line J-J.

A compression station 150 shown in FIG. 5, and in detail in FIG. 10, transitions the substantially tubular work piece 140, into an untrimmed tubular work piece with integral bracket shown generally at 152 by forcing opposing side edges 92, and 96 of the workpiece shown in FIG. 2 together forming a seam 154. In this station, the upper die member 42 contains a compression punch 156 which is substantially similar in shape to the U-shaped bend 120, of the U-shaped blank 108; however in this station the form is slightly smaller than the radius 136 of the substantially tubular work piece 140.

Attached to the lower portion 40 of the die shown in FIG. 10 is a compression die 158 which contains a substantially "U" shaped form 160 which directs the opposing side edges 94, and 96 of the substantially tubular work piece 140 shown in FIG. 2, together when the compression punch 156 is moved toward compression die 158. This forms a tubular section 162, with a seam 154 when the opposing side edges 94 and 96 contact each other. The compression punch 156 and the compression die 158 are then brought closer to one another, forcing the opposing edges 94, and 96 into intimate contact with one another creating a tightly fitted seam 154, with additional load being transmitted into the annular form and evenly distributed. Thereafter additional tool travel bringing the compression punch 156, toward compression die 158, will force the diameter of the tubular section 162, to be reduced. Since the form is already bounded by tools, 156 and 158, and seam 154 lies in intimate contact, any additional displacement applied to the tool will act normal (perpendicular) to the applied annular load, thereby increasing the wall thickness 164 of the tubular section 162.

Once the form is bounded by the compression punch 156 and compression die 158 shown in FIG. 10, and the seam is in intimate contact, the form's material will flow around optional coining tool 166, if present. Coining tool 166 comprises a coining punch 168, which as shown in this example, is part of the compression die tool 156; however it could alternately be mounted in compression punch 158. Optional coining tool 166 allows one or more coined regions 170 shown in FIG. 2, to be placed into the tubular section 162 of the workpiece without substantially deforming areas outside of the coined 170 region. Alternate embodiments of the coining tool 166 may lie outside of the compression punch 156, and compression die 158 as separate tools. These tools may also be incorporated in other stations, including but not limited to blanking station 52; forming station 72; drawforming station 106; closure station 138; restriking station 172; or trim station 178.

In alternate forms of the invention, there may be additional compression 150 or closure stations 138 located in the tool 30. In the instance where multiple stations are utilized, the diameter and overall shape of the cavities formed will preferably progress ever smaller toward the final shape. This is particularly true for the final stations such as compression station 150 shown at FIG. 10 (and subsequent similar stations) where the work piece may be subjected to a re-striking which imparts the final shape and wall thickness to the work piece. As each station becomes progressively smaller, the overall shape of the work product becomes more compact. That is to say that with each stroke of the die assembly, the exterior surface of the work piece receives a force substantially perpendicular or normal to its surface. Because of the tubular structure, and acting much like a keystone works in an arch, the perpendicular force is transferred to the sheet metal adjacent thereto, causing opposing forces about the tubular structure. As the force is increased, any deformation in the work piece occurs in the thickness of the wall, producing an increase in the overall wall thickness. This annular redistribution of pressure produced by the re-striking step also results in the butt ends of the edges of the sheet metal, now in contact with one another, to conform closely to one another, forming a substantially intimately fitting seam. One example of a re-striking station is shown generally at 172 in FIG. 5 and in detail in FIG. 11.

Figure 20:
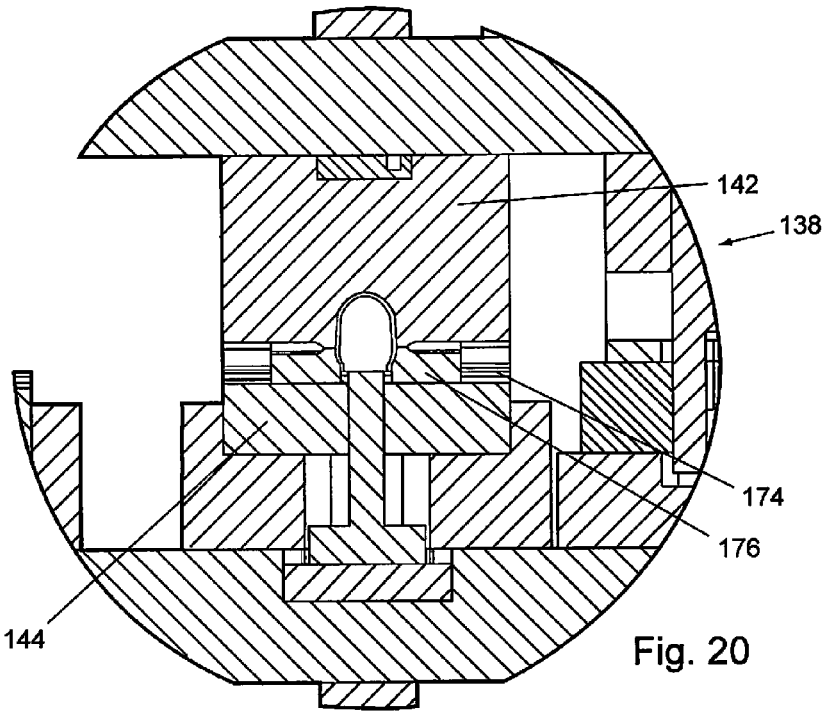
FIG. 20 is an alternate form of the tool shown in FIG. 8 including a wedge member.

In a further form of the invention, exemplary closure station 138 shown at FIG. 20, may include a frustum or wedge shaped member 174 adapted to engage a corresponding inclined or wedge shaped surface 176 on the closure punch 142 such that as the two components come into engagement, the two engaging wedged surfaces cause the tooling to translate inwardly to engage the walls 122, and 125 of the work piece shown in FIG. 2. As the wedge 176 translates inwardly, a mechanism may be provided such that the tooling is automatically actuated to perform the desired operation. One example may be a clutch mechanism on the closure station 138 designed to engage a continually running drive member disposed within the die assembly 30 whereby the drive would actuate the tool as the tool contacted the work piece. In this manner, the wedge shaped members 174 and 176, translate the material at the side edges 94, and 96 of the sheet metal causing them to conform closely to one another, forming seam 154.

A trim station 178 shown at FIGS. 3 and 4, trims the untrimmed tubular work piece with integral bracket 152, and punches mounting holes 180 creating a stamped tubular form with integrated bracket shown generally at 182 of FIG. 2. As the workpiece enters the trim station 178 it is positively located in the tool by a set of piloting pins 184, which engage optional pilot hole 60 of the untrimmed tubular work piece with integral bracket 152. Alternately, if optional pilot hole 60 is not present, other exterior features will be used to positively align the untrimmed tubular work piece with integral bracket 152 within the trim station 178.

The trim station 178 shown in FIGS. 3 and 4 contains a trim punch 186 and first requalification surface 188 which are located in the upper portion 42 of the die assembly 30. The trim station 178 and first requalification surface 188 work in combination with a trim die 190, hole punch 192 and second requalification surface 194 located in the lower 40 portion of the die assembly 30 to pierce hole 180 shown in FIG. 2, and to trim the workpiece in a scissors-like motion by passing the trim punch 186, shown in FIG. 3, past the trim die 190, shown in FIG. 4. This removes extra material and separates the stamped tubular form with integrated bracket 182 from the carrier strip 36. Requalification surfaces 188 and 194 are then brought into contact with the bracket portion 126 of the workpiece in order to flatten the bracket portion 126 and align it with the tubular section 162 of the stamped tubular form with integrated bracket 182.

Figure 21:
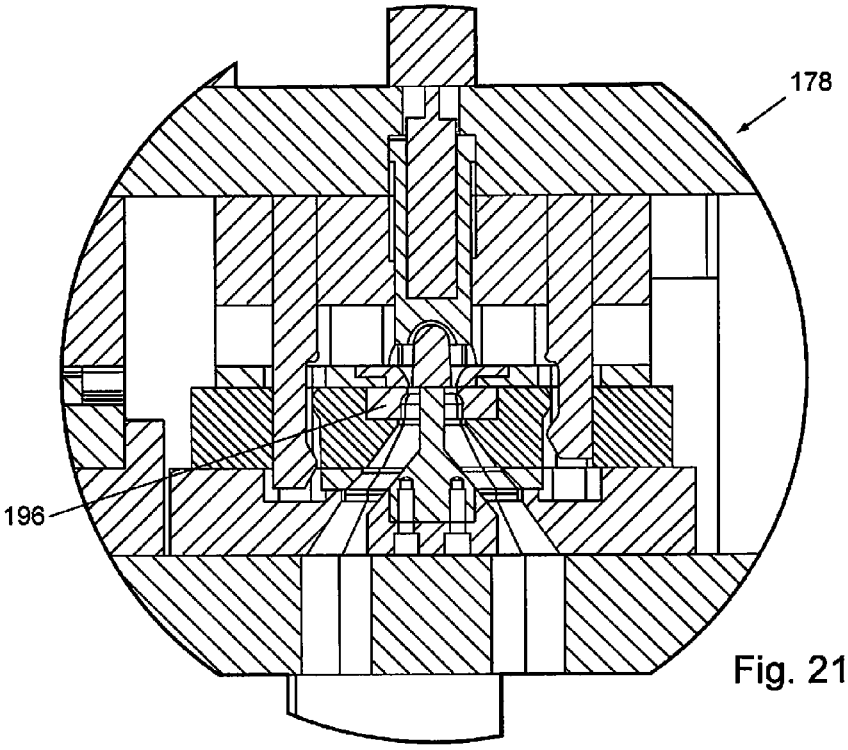
FIG. 21 is an alternate form of a trim station taken along line A-A shown in FIGS. 3 and 4 including a wedge member.

An exemplary trim station 178, shown in FIG. 21 may optionally include a frustum or wedge shaped member 196 adapted to engage a corresponding inclined or wedge shaped surface on the tooling such that as the two components come into engagement, the two engaging wedged surfaces cause the tooling to translate inwardly to engage the bracket 126, shown in FIG. 2. As the wedge tooling 194 translates inwardly, a mechanism may be provided such that the tooling is automatically actuated to perform the desired operation. One example may be a clutch mechanism on the tool designed to engage a continually running drive member disposed within the trim station 178 thereby actuating the tool to trim the stamped tubular form with integral bracket 182.

Figure 16:
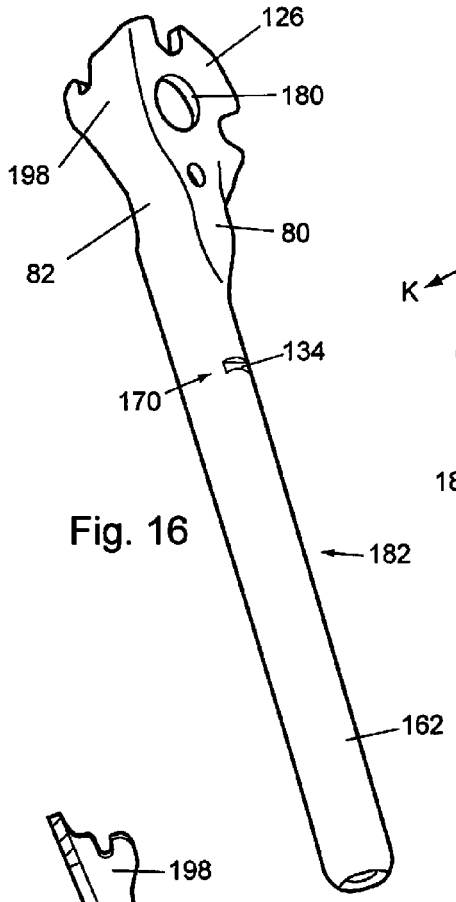
FIG. 16 is an isometric view of a second tubular form with integral bracket created according to another embodiment of the invention.
Figure 17:
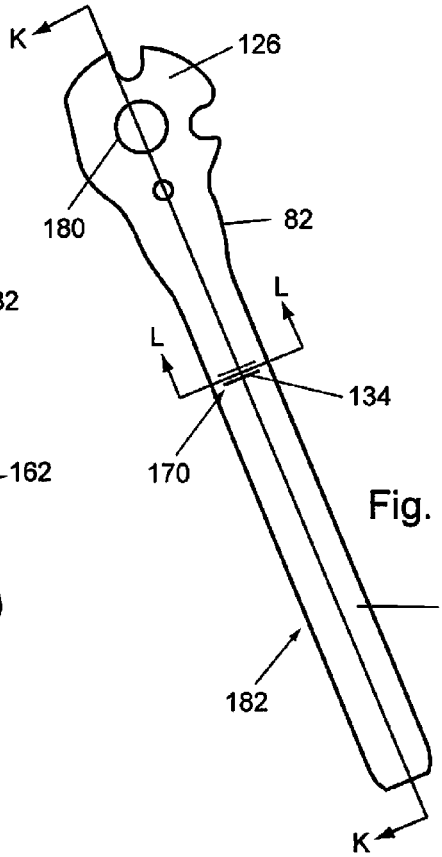
FIG. 17 is a top view of the tubular form with integral bracket shown in FIG. 16.
Figure 18:
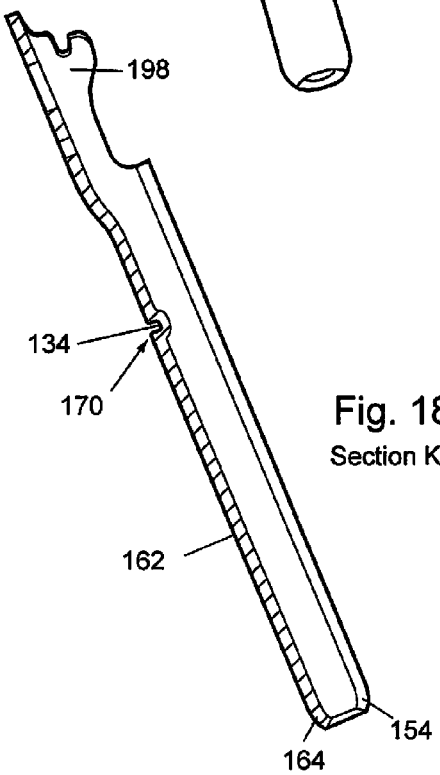
FIG. 18 is a cross section view of the tubular form with integral bracket shown in FIG. 17 taken along line K-K.
Figure 19:
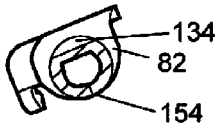
FIG. 19 is a cross section view of the tubular form with integral bracket shown in FIG. 17 taken along line L-L.

The tubular forms created by the process and described above represent one principal embodiment of the invention. Alternate forms of the invention may include a central bracket with more than one tubular section 162, or may include a central tubular section 162, with more than one integrated bracket portion 126 located at its periphery. Further the tubular section 162 may contain one or more wall portions 198, as shown in FIG. 16, which extend from the tubular sections onto the integrated bracket portion 126 to provide additional stiffness and support. Further, holes may be placed in the tubular section 162 of the workpiece by replacing the coining stations with additional punches; or via the blanking station 52 shown in FIG. 6, wherein two half circles are be placed into opposing sides 94 and 96 of the blank. Which, when closed by the closure station 138 will form seam 154 with a circular hole.

Additional stamped tubular forms with integrated brackets are anticipated to be covered by this method, and include without limitation: headrest tubes, brake handles, adjustment levers, tool grips, as well as generally any other use where a tubular form is traditionally affixed to a bracket. The principal benefit of a product made by the inventive process is that the stamped tube is permanently affixed to the bracket resulting in tighter alignment tolerances compared to similarly welded parts. Stamped tubes formed by this process are able to be formed with an internal diameter as small as approximately five millimeters with wall thicknesses that are uniform to within +/−0.005 millimeter of the original stock thickness. Consequently this inventive process is able to create a tubular product that has an improved surface appearance, tightly formed seams which are safe to handle, and a smooth interior profile attached to an integrated bracket without the need for welding.

The tubular forms created by the process and described above are preferably manufactured from coiled flat stock, such as aluminum or steel sheet of a uniform thickness; however any material suitable for use with a stamping dies may be used with the described process. The process described above is considered that of the preferred embodiment only. Modifications of the invention will occur to those skilled in the art and those who make or use the invention. Therefore, it is understood that the embodiments shown in the drawings and the examples set forth herein are described merely for illustrative purposes and not intended to limit the scope of the invention as interpreted according to the principles of patent law, including the doctrine of equivalents.

The invention claimed is:

1. A process for making a stamped tubular form containing an integral bracket comprising the steps of:

providing a sheet of flat metal stock having a first wall thickness;

punching a blank stock containing an integral bracket and a tubular blank from said flat sheet of metal;

forming said tubular blank using a stamping die of a plurality of successive stamping dies into a partially closed form containing two wall members, each having a longitudinal edge;

bending a portion of said two wall members toward one another in another of said plurality of successive stamping dies until said longitudinal edges are proximate one another substantially forming a tubular shape;

abutting said longitudinal edges of said tubular shape; stamping the substantially formed tubular work piece in yet another of said plurality of successive stamping dies to tightly abut said at least two opposing edges against one another, closing a seam of the tubular work piece, and compacting the substantially formed tubular work piece into a finished tubular work piece; and wherein the process further comprises coining an indentation in said tubular blank.

2. The process of claim 1 further comprising trimming said tubular blank.

3. The process of claim 1 further comprising punching a hole in said tubular blank.

4. The process of claim 1 further comprising punching a hole in said integral bracket.

5. The process of claim 1 further comprising coining an indentation in said tubular shape.

6. The process of claim 1 further comprising stamping a dart into said integral bracket.

7. The process of claim 1 wherein said stamping die is a progressive die assembly.

8. The process of claim 1 wherein said stamping die is a transfer die assembly.

9. A stamped tubular form containing an integral bracket manufactured by the process of claim 1.

* * * * *